US008888993B2

(12) United States Patent
Verma et al.

(10) Patent No.: US 8,888,993 B2
(45) **Date of Patent: *Nov. 18, 2014**

(54) TREATMENT OF A HYDROCARBON FEED

(75) Inventors: Akshay Verma, Richmond, CA (US); Bi Zeng Zhan, Albany, CA (US); Zunqing He, San Rafael, CA (US); Zhen Zhou, Emeryville, CA (US); Marcus Dutra e Mellon, Moraga, CA (US); Sheila Yeh, Orinda, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 733 days.

This patent is subject to a terminal disclaimer.

(21) Appl. No.: 13/180,629

(22) Filed: Jul. 12, 2011

(65) Prior Publication Data

US 2012/0024756 A1 Feb. 2, 2012

Related U.S. Application Data

(63) Continuation-in-part of application No. 12/847,107, filed on Jul. 30, 2010, now Pat. No. 8,540,871.

(51) Int. Cl.

| | |
|---|---|
| ***C10G 25/00*** | (2006.01) |
| ***C10G 25/12*** | (2006.01) |
| ***C10G 45/58*** | (2006.01) |

(52) U.S. Cl.

CPC ..... *C10G 25/003* (2013.01); *C10G 25/12* (2013.01); *C10G 45/58* (2013.01); *C10G 2400/10* (2013.01); *C10G 2300/107* (2013.01); *C10G 2300/1074* (2013.01); *C10G 2300/1077* (2013.01); *C10G 2300/202* (2013.01)

USPC ..... 208/236; 208/91; 208/208 R; 208/254 R

(58) Field of Classification Search

USPC ..... 208/91, 99, 207, 236, 289, 208 R, 254 R, 208/310 R, 310 Z; 502/400, 401, 407–418; 540/1; 548/400, 401, 407–418

See application file for complete search history.

(56) References Cited

U.S. PATENT DOCUMENTS 5,104,840 A 4/1992 Chauvin et al.
5,454,933 A * 10/1995 Savage et al. ..... 208/212

(Continued)

FOREIGN PATENT DOCUMENTS

EP 0079778 A1 5/1983
WO WO 2010/116165 * 10/2010
WO WO2011011830 2/2011

OTHER PUBLICATIONS

Han et al., Effects of Surface Treatment of MCM-41 on Motions of Confined Liquids, J. Phys. D: Appl. Phys. 40, Aug. 2007, pp. 5743-5746.*

(Continued)

*Primary Examiner* — Prem C Singh
*Assistant Examiner* — Brandi M Doyle
(74) *Attorney, Agent, or Firm* — Parul A. Anderson; Gregory L. Porter

(57) ABSTRACT

A method is disclosed for removing impurities such as nitrogen and/or sulfur compounds from a hydrocarbon feed, in which the feed is contacted with an adsorbent including a nitrogen-containing organic heterocyclic salt deposited on a porous support, e.g., a supported ionic liquid. Additionally, a method for hydrotreating a hydrocarbon feed which includes a hydroprocessing step is disclosed, wherein prior to hydroprocessing, the feed is contacted with an adsorbent including a supported ionic liquid. Additionally, a method for producing a lube oil which includes isomerization dewaxing of a base oil fraction is disclosed, wherein prior to the isomerization dewaxing step, the base oil fraction is contacted with an adsorbent including a supported ionic liquid. In one embodiment, the adsorbent is regenerated to restore its treatment capacity.

21 Claims, 3 Drawing Sheets

(56) References Cited

U.S. PATENT DOCUMENTS

| | | | | |
|---|---|---|---|---|
| 5,731,101 | A | 3/1998 | Sherif et al. | |
| 6,096,680 | A | 8/2000 | Park | |
| 6,274,026 | B1 | 8/2001 | Schucker et al. | |
| 6,339,182 | B1 | 1/2002 | Munson et al. | |
| 6,392,109 | B1 | 5/2002 | O'Rear et al. | |
| 6,569,313 | B1 * | 5/2003 | Carroll et al. | 208/49 |
| 6,673,737 | B2 | 1/2004 | Mehnert et al. | |
| 6,797,853 | B2 | 9/2004 | Houzvicka et al. | |
| 6,841,711 | B2 | 1/2005 | Krug et al. | |
| 6,852,229 | B2 | 2/2005 | Mehnert et al. | |
| 6,969,693 | B2 | 11/2005 | Sauvage et al. | |
| 7,001,504 | B2 | 2/2006 | Schoonover | |
| 7,141,157 | B2 | 11/2006 | Rosenbaum et al. | |
| 7,198,712 | B2 | 4/2007 | Olivier-Bourbigou et al. | |
| 7,374,666 | B2 | 5/2008 | Wachs | |
| 7,553,406 | B2 | 6/2009 | Wasserscheid et al. | |
| 7,586,017 | B2 | 9/2009 | Van Driessche et al. | |
| 7,629,491 | B2 | 12/2009 | Zoeller et al. | |
| 7,645,438 | B2 | 1/2010 | Edvinsson-Albers et al. | |
| 7,709,635 | B2 | 5/2010 | Davis, Jr. | |
| 7,732,651 | B2 | 6/2010 | Driver et al. | |
| 7,749,377 | B2 | 7/2010 | Serban et al. | |
| 7,749,475 | B2 | 7/2010 | Kim et al. | |
| 7,758,745 | B2 | 7/2010 | Cheng | |
| 7,763,768 | B2 | 7/2010 | Al Nashef et al. | |
| 7,790,021 | B2 | 9/2010 | Kocal et al. | |
| 7,799,299 | B2 | 9/2010 | Heldebrant et al. | |
| 7,901,646 | B2 | 3/2011 | Ayala et al. | |
| 7,914,688 | B2 | 3/2011 | Anderson et al. | |
| 7,919,631 | B2 | 4/2011 | Buchanan et al. | |
| 8,067,488 | B2 | 11/2011 | Buchanan et al. | |
| 8,075,803 | B2 | 12/2011 | Kalb | |
| 2001/0006154 | A1 | 7/2001 | Krug et al. | |
| 2002/0189444 | A1 | 12/2002 | Brennecke et al. | |
| 2002/0193649 | A1 | 12/2002 | O'Rear et al. | |
| 2002/0198100 | A1 * | 12/2002 | Mehnert et al. | 502/150 |
| 2003/0000867 | A1 * | 1/2003 | Reynolds | 208/89 |
| 2003/0085156 | A1 * | 5/2003 | Schoonover | 208/230 |
| 2004/0045874 | A1 * | 3/2004 | Olivier-Bourbigou et al. | 208/238 |
| 2004/0077914 | A1 | 4/2004 | Zavilla et al. | |
| 2004/0133056 | A1 | 7/2004 | Liu et al. | |
| 2004/0178118 | A1 | 9/2004 | Rosenbaum et al. | |
| 2004/0267070 | A1 | 12/2004 | Johnson et al. | |
| 2005/0010076 | A1 | 1/2005 | Wasserscheid et al. | |
| 2005/0150819 | A1 | 7/2005 | Wachs | |
| 2005/0194561 | A1 | 9/2005 | Davis | |
| 2005/0245778 | A1 | 11/2005 | Johnson et al. | |
| 2006/0287521 | A1 | 12/2006 | Davis, Jr. | |
| 2007/0119302 | A1 | 5/2007 | Radosz et al. | |
| 2007/0219379 | A1 | 9/2007 | Itoh et al. | |
| 2007/0282143 | A1 | 12/2007 | Driver et al. | |
| 2007/0286783 | A1 | 12/2007 | Carrette et al. | |
| 2008/0011161 | A1 | 1/2008 | Finkenrath et al. | |
| 2008/0044343 | A1 | 2/2008 | Edvinsson-Albers et al. | |
| 2008/0159064 | A1 | 7/2008 | Wang et al. | |
| 2008/0194807 | A1 | 8/2008 | Buchanan et al. | |
| 2008/0194808 | A1 | 8/2008 | Buchanan et al. | |
| 2008/0194834 | A1 | 8/2008 | Buchanan et al. | |
| 2008/0251759 | A1 | 10/2008 | Kalb et al. | |
| 2009/0012346 | A1 | 1/2009 | Al Nashef et al. | |
| 2009/0065399 | A1 | 3/2009 | Kocal et al. | |
| 2009/0071335 | A1 | 3/2009 | Tonkovich et al. | |
| 2009/0101592 | A1 | 4/2009 | Anderson et al. | |
| 2009/0107032 | A1 | 4/2009 | Lacheen et al. | |
| 2009/0120841 | A1 * | 5/2009 | Serban et al. | 208/209 |
| 2009/0136402 | A1 | 5/2009 | Heldebrant et al. | |
| 2009/0176956 | A1 | 7/2009 | Grinstaff et al. | |
| 2009/0203898 | A1 | 8/2009 | Buchanan et al. | |
| 2009/0203899 | A1 | 8/2009 | Buchanan et al. | |
| 2009/0203900 | A1 | 8/2009 | Buchanan et al. | |
| 2009/0236266 | A1 | 9/2009 | Cheng | |
| 2009/0263302 | A1 | 10/2009 | Hu | |
| 2009/0288992 | A1 | 11/2009 | Victorovna Likhanova et al. | |
| 2010/0015040 | A1 | 1/2010 | Kim et al. | |
| 2010/0024645 | A1 | 2/2010 | Tonkovich et al. | |
| 2010/0029927 | A1 | 2/2010 | Buchanan et al. | |
| 2010/0041869 | A1 | 2/2010 | Chan et al. | |
| 2010/0051509 | A1 | 3/2010 | Martinez Palou et al. | |
| 2010/0116713 | A1 | 5/2010 | Ortega Garcia et al. | |
| 2010/0129921 | A1 | 5/2010 | Timken et al. | |
| 2010/0130804 | A1 | 5/2010 | Timken et al. | |
| 2010/0147740 | A1 | 6/2010 | Elomari et al. | |
| 2010/0160703 | A1 | 6/2010 | Driver et al. | |
| 2010/0179311 | A1 | 7/2010 | Earle et al. | |
| 2010/0193401 | A1 | 8/2010 | Nares Ochoa et al. | |
| 2010/0242728 | A1 | 9/2010 | Radosz et al. | |
| 2010/0251887 | A1 | 10/2010 | Jain | |
| 2010/0264065 | A1 | 10/2010 | Hamad et al. | |
| 2010/0267942 | A1 | 10/2010 | Buchanan et al. | |
| 2010/0270211 | A1 | 10/2010 | Wolny | |
| 2010/0273642 | A1 | 10/2010 | Chang et al. | |
| 2010/0294489 | A1 | 11/2010 | Dreher, Jr. et al. | |
| 2010/0300286 | A1 | 12/2010 | Gu et al. | |
| 2010/0305249 | A1 | 12/2010 | Buchanan et al. | |
| 2011/0000823 | A1 | 1/2011 | Hamad et al. | |
| 2011/0020509 | A1 | 1/2011 | Kalb | |
| 2011/0033647 | A1 | 2/2011 | Hsiao et al. | |
| 2011/0052466 | A1 | 3/2011 | Liu | |
| 2011/0073805 | A1 | 3/2011 | Dibble et al. | |
| 2011/0081286 | A1 | 4/2011 | Sasson et al. | |
| 2011/0111508 | A1 | 5/2011 | Timken et al. | |
| 2011/0130602 | A1 | 6/2011 | Hommeltoft et al. | |
| 2011/0155635 | A1 | 6/2011 | Serban et al. | |
| 2011/0155638 | A1 | 6/2011 | Bhattacharyya et al. | |
| 2011/0155644 | A1 | 6/2011 | Bhattacharyya et al. | |
| 2011/0183423 | A1 | 7/2011 | Timken et al. | |
| 2011/0184219 | A1 | 7/2011 | Timken et al. | |
| 2011/0213138 | A1 | 9/2011 | Buchanan et al. | |
| 2011/0215052 | A1 | 9/2011 | Guzman Lucero et al. | |
| 2011/0220506 | A1 | 9/2011 | Kelkar et al. | |
| 2011/0223085 | A1 | 9/2011 | Kelkar et al. | |
| 2011/0233112 | A1 | 9/2011 | Koseoglu et al. | |
| 2011/0233113 | A1 | 9/2011 | Koseoglu et al. | |
| 2011/0236295 | A1 | 9/2011 | Anderson et al. | |
| 2011/0306760 | A1 | 12/2011 | Buchanan et al. | |

OTHER PUBLICATIONS

PCT International Search Report, International Application No. PCT/US2011/043733, dated Jun. 1, 2012.

Lara Sanchez, Functionalized Ionic Liquids—Absorption Solvents for Carbon Dioxide and Olefin Separation, 200 page Thesis, dated Dec. 17, 2008, link to document at http://alexandria.tue.nl/extra2/200811940.pdf.

Liang Lu et al., Deep Oxidative Desulfurization of Fuels Catalyzed by Ionic Liquid in the Presence of $H_2O_2$ Energy Fuels, 2007, 21 (1), pp. 383-384.

Zhao, Dishun et al., Oxidative desulfurization of thiophene catalyzed by (C4H9)4NBr• 2C6H11NO coordinated ionic liquid, Energy and Fuels, v 22, n 5, Sep./Oct. 2008, p. 3065-3069.

* cited by examiner

TREATMENT OF A HYDROCARBON FEED

FIELD

The present disclosure is directed generally to a process for treating a hydrocarbon feed by contacting the feed with an adsorbent material to remove sulfur and nitrogen compounds.

BACKGROUND

Environmental regulations increasingly mandate liquid fuels containing very low levels of sulfur and nitrogen species. Hydrotreating is the most often used method for reducing sulfur and nitrogen content in a hydrocarbon feed. In general, harsher hydrotreating process conditions and advanced catalysts are required to further reduce sulfur from about 20 ppm to less than about 1 ppm, because of recalcitrant sulfur and nitrogen species to be reduced, including, for instance, 4,6-dimethyl dibenzothiophene, methyl, ethyl dibenzothiophene, trimethyl dibenzothiophene, carbazole and alkyl-substituted carbazole. The harsh hydrotreating conditions in turn result in further hydrocracking of diesel and jet fuel to $C_1$-$C_4$ gas and naphthene products, which may be undesired, as well as undesirable high hydrogen consumption.

It would be desirable to develop a process to reduce sulfur and nitrogen compounds in a hydrocarbon feed while avoiding the aforementioned problems. It is known that prior removal of nitrogen compounds from the hydrocarbon feed results in increasing the sulfur removal capacity, since both nitrogen and sulfur compounds target the same adsorption and/or hydrodesulfurization sites on the adsorbent or hydroprocessing catalyst and nitrogen being more polar is preferentially adsorbed.

Ionic liquids immobilized on a functionalized support have been used as catalysts, for example, in the hydroformulation reactions/Friedel-Crafts reactions.

There is a need for an improved process employing supported ionic liquids, in which sulfur and nitrogen compounds, such as carbazole and indole and their alkyl substitutes would be removed from hydrocarbon feeds.

SUMMARY

One embodiment relates to a method for removing nitrogen and sulfur compounds from a hydrocarbon feed by contacting the feed with an adsorbent including an organic heterocyclic salt deposited on a porous support, resulting in a product containing a reduced amount of nitrogen and sulfur as compared with the feed.

Another embodiment relates to a method for hydroprocessing a hydrocarbon feed in which the feed is first treated with an adsorbent including an organic heterocyclic salt deposited on a support to form an intermediate stream with reduced levels of nitrogen and sulfur compounds, and the intermediate stream is subsequently contacted with a hydrocracking catalyst.

Another embodiment relates to a method for producing a lube oil in which a hydrocarbon feed is contacted with a hydrocracking catalyst, the hydrocracked feed is separated into at least one light fraction and a base oil fraction, and the base oil fraction is contacted with a bed of isomerization dewaxing catalyst, wherein prior to contacting the feed with the isomerization dewaxing catalyst, the base oil fraction is treated with an adsorbent including an organic heterocyclic salt deposited on a support.

DETAILED DESCRIPTION

Figure 1:
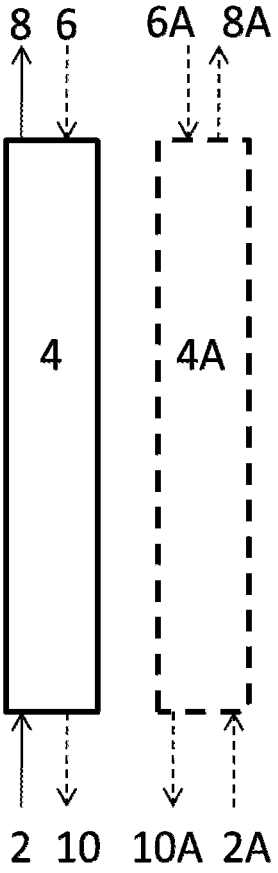
FIG. 1 illustrates one embodiment of a process to treat hydrocarbon feeds utilizing an adsorbent and optional regeneration of the adsorbent.

In one embodiment, the disclosure provides a process for reducing nitrogen compounds ("denitrification") and sulfur compounds ("desulfurization") in a hydrocarbon feed.

A referene to "nitrogen" is by way of exemplification of elemental nitrogen by itself as well as compounds that contain nitrogen. Similarly, a reference to "sulfur" is by way of exemplification of elemental sulfur as well as compounds that contain sulfur.

Hydrocarbon Feedstock:

In one embodiment, the process is for treating hydrocarbon feeds containing greater than 1 ppm nitrogen. In one embodiment, the feed is a hydrocarbon having a boiling temperature within a range of 93° C. to 649° C. (200° F. to 1200° F.). Exemplary hydrocarbon feeds include petroleum fractions such as hydrotreated and/or hydrocracked products, coker products, straight run feed, distillate products, FCC bottoms, atmospheric and vacuum bottoms, vacuum gas oils and unconverted oils including crude oil.

In one embodiment, the hydrocarbon feed is a hydrotreated base oil or unconverted oil fraction containing between 3 ppm and 6000 ppm nitrogen. In another embodiment, the feed contains greater than 500 ppm nitrogen. In another embodiment, the feed contains greater than 200 ppm nitrogen. In another embodiment, the feed contains greater than 100 ppm nitrogen. In another embodiment, the feed contains greater than 10 ppm nitrogen. In another embodiment, the feed contains greater than 1 ppm nitrogen. In one embodiment, the hydrocarbon feed contains less than 200 ppm sulfur compounds.

The feed may include nitrogen-containing compounds such as, for example, imidazoles, pyrazoles, thiazoles, isothiazoles, azathiozoles, oxothiazoles, oxazines, oxazolines, oxazoboroles, dithiozoles, triazoles, selenozoles, oxaphospholes, pyrroles, boroles, furans, pentazoles, indoles, indolines, oxazoles, isooxazoles, isotriazoles, tetrazoles, thiadiazoles, pyridines, pyrimidines, pyrazines, pyridazines, piperazines, piperidines, morpholenes, phthalzines, quinazolines, quinoxalines, quinolines, isoquinolines, thazines, oxazines, and azaannulenes. In addition acyclic organic systems are also suitable. Examples include, but are not limited to amines (including amidines, imines, guanidines), phosphines (including phosphinimines), arsines, stibines, ethers, thioethers, selenoethers and mixtures of the above. Examples of sulfur compounds in feed that are difficult to remove include but are not limited to heterocyclic compounds containing sulfur such as benzothiophene, alkylbenzothiophene, multi-alkylbenzothiophene and the like, dibenzothiophene (DBT), alkyldibenzothiophene, multi-alkyldibenzothiophene, such as 4,6-dimethyldibenzothiophene (4,6-DMDBT)) and the like.

In one embodiment of the adsorption treatment process, the sulfur and/or nitrogen content of the hydrocarbon feed stream is reduced by at least 10%, 25%, 50%, 75% or 90%. In one embodiment, the removal rate is at least 50%. In one embodiment, the treated product has less than 1000 ppm nitrogen. In another embodiment, the treated product has less than 500 ppm nitrogen. In another embodiment, the treated product has less than 100 ppm nitrogen. In another embodiment, the treated product has less than 1 ppm nitrogen. In another embodiment, the treated product has less than the detectable limit of nitrogen. In one embodiment, the adsorbent has been found to have higher selectivity for nitrogen compounds than for aromatics or sulfur compounds. In one embodiment after treatment, the treated product has less than 10 ppm sulfur. In another embodiment, the sulfur level in the treated product is less than 5 ppm.

Supported Ionic Liquids:

The treatment includes contacting the hydrocarbon feed with a nitrogen-containing organic heterocyclic salt deposited on a porous support as a solid adsorbent, whereby undesirable nitrogen and sulfur impurities in the hydrocarbon feed being adsorbed by the adsorbent; separating and removing the solid adsorbent containing nitrogen and sulfur impurities.

In one embodiment, the organic heterocyclic salt has a general formula of:

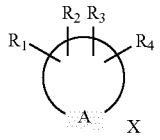

wherein:

A is a nitrogen cation containing heterocyclic group selected from the group consisting of imidazolium, pyrazolium, 1,2,3-triazolium, 1,2,4-triazolium, pyridinium, pyrazinium, pyrimidinium, pyridazinium, 1,2,3-triazinium, 1,2,4-triazinium, 1,3,5-triazoinium, quinolinium, and isoquinolinium;

$R_1$, $R_2$, $R_3$, and $R_4$ are substituent groups attached to the carbon or nitrogen of the heterocyclic group A, independently selected from the group consisting of hydroxyl, amino, acyl, carboxyl, linear unsubstituted $C_1$-$C_{12}$ alkyl groups, branched unsubstituted $C_1$-$C_{12}$ alkyl groups, linear $C_1$-$C_{12}$ alkyl groups substituted with oxy, amino, acyl, carboxyl, alkenyl, alkynyl, trialkoxysilyl, and alkyldialkoxysilyl groups, branched substituted $C_1$-$C_{12}$ alkyl groups substituted with oxy, amino, acyl, carboxyl, alkenyl, alkynyl, trialkoxysilyl, and alkyldialkoxysilyl groups; and X is an inorganic or organic anion selected from the group consisting of fluoride, chloride, bromide, iodide, aluminum tetrachloride, heptachlorodialuminate, sulfite, sulfate, phosphate, phosphoric acid, monohydrogen phosphate, dihydrogen phosphate, bicarbonate, carbonate, hydroxide, nitrate, trifluoromethanesulfonate, sulfonate, phosphonate, carboxylate groups of $C_2$-$C_{18}$ organic acids, and chloride or fluoride substituted carboxylate groups.

The nitrogen-containing organic heterocyclic salt can also include ionic liquids. Ionic liquids are liquids containing predominantly anions and cations. The cations associated with ionic liquids are structurally diverse, but generally contain one or more nitrogens that are part of a ring structure and can be converted to a quaternary ammonium. Examples of these cations include pyridinium, pyridazinium, pyrimidinium, pyrazinium, imidazolium, pyrazolium, oxazolium, triazolium, thiazolium, piperidinium, pyrrolidinium, quinolinium, and isoquinolinium. The anions associated with ionic liquids can also be structurally diverse and can have a significant impact on the solubility of the ionic liquids in different media.

In one embodiment, the organic heterocyclic salt is a carboxylated ionic liquid. As used herein, the term "carboxylated ionic liquid" shall denote any ionic liquid comprising one or more carboxylate anions. Carboxylate anions suitable for use in the carboxylated ionic liquids of the present process include, but are not limited to, $C_1$ to $C_{20}$ straight- or branched-chain carboxylate or substituted carboxylate anions. Examples of suitable carboxylate anions for use in the carboxylated ionic liquid include, but are not limited to, formate, acetate, propionate, butyrate, valerate, hexanoate, lactate, oxalate, or chloro-, bromo-, fluoro-substituted acetate, propionate, or butyrate and the like. In one embodiment, the anion of the carboxylated ionic liquid is a $C_2$ to $C_6$ straight-chain carboxylate. Furthermore, the anion can be acetate, propionate, butyrate, or a mixture of acetate, propionate, and/or butyrate.

Examples of suitable carboxylated ionic liquids include, but are not limited to, 1-ethyl-3-methylimidazolium acetate, 1-ethyl-3-methylimidazolium propionate, 1-ethyl-3-methylimidazolium butyrate, 1-butyl-3-methylimidazolium acetate, 1-butyl-3-methylimidazolium propionate, 1-butyl-3-methylimidazolium butyrate, or mixtures thereof.

In one embodiment, the nitrogen-containing organic heterocyclic salt is deposited on an inorganic support. "Inorganic support" here means a support that comprises an inorganic material. Suitable inorganic materials may include, for example, activated carbon, oxides, carbides, nitrides, hydroxides, carbonitrides, oxynitrides, borides, silicates, or borocarbides. In one embodiment, the inorganic support is a porous material having an average pore diameter of between 0.5 nm and 100 nm. In one embodiment, the pores of the support material have an average pore diameter of between 0.5 nm and 50 nm. In one embodiment, the pores of the support material have an average pore diameter of between 0.5 nm and 20 nm. The porous support material has a pore volume of between 0.1 and 3 $cm^3/g$. Suitable materials include inorganic oxides and molecular sieves with 8, 10, and 12-rings, silica, alumina, silica-alumina, zirconia, titanium oxide, magnesium oxide, thorium oxide, beryllium oxide, activated carbon and mixtures thereof. Example of molecular sieves include 13X, zeolite-Y, USY, ZSM-5, ZSM-22, ZSM-23, ZSM-35, ZSM-48, MCM-22, MCM-35, MCM-58, SAPO-5, SAPO-11, SAPO-35, VPI-5.

In one embodiment with activated carbon as the support material, the carbon support can have a BET surface area of between 200 $m^2/g$ and 3000 $m^2/g$. In another embodiment, the carbon support has a BET surface area of between 500 $m^2/g$ and 3000 $m^2/g$. In another embodiment, the carbon support has a BET surface area of between 800 $m^2/g$ and 3000 $m^2/g$. In another embodiment with a support material selected from silica, alumina, silica-alumina, clay and mixtures thereof, the support can have a BET surface area of between 50 $m^2/g$ and 1500 $m^2/g$. In another embodiment, the support selected from silica, alumina, clay and mixtures thereof has a BET surface area of between 150 $m^2/g$ and 1000 $m^2/g$. In another embodiment, the support selected from silica, alumina, clay and mixtures thereof has a BET surface area of between 200 $m^2/g$ and 800 $m^2/g$.

Deposition of the organic heterocyclic salts on the support can be carried out in various ways including, but not limited to, impregnation, grafting, polymerization, co-precipitation, sol gel method, encapsulation or pore trapping. In one method, the support maternal is impregnated with an organic heterocyclic salt diluted with an organic solvent, such as acetone. The impregnation followed by the evaporation of the solvent results in a uniform and thin organic heterocyclic salt layer on the support material. When organic heterocyclic salts prepared in such a manner are used in a liquid phase process, a bulk solvent that is miscible with the organic heterocyclic salt is chosen.

In one embodiment, the deposition of organic heterocyclic salt onto a porous support is through grafting by covalent bond interaction in a format of "—X—Si—O-M-," where M is a framework atom of porous material and X is a species which acts a bridge to connect organic heterocyclic cations. In one embodiment, the X is carbon atom.

In one embodiment, the solid adsorbent comprises ionic liquids immobilized on a functional support as disclosed in U.S. Pat. No. 6,969,693, the relevant disclosures including methods for making are included herein by reference. In another embodiment, the solid adsorbent comprises a supported ionic liquid as disclosed in U.S. Pat. No. 6,673,737 the disclosure including methods of making are included herein by reference.

Treatment Process:

The treatment process of bringing the hydrocarbon feedstock to come in contact with the solid adsorbent can be carried out as a batch process or a continuous process. In one embodiment, the temperature of the treatment process ranges from 0° C. to 200° C., alternatively from 10° C. to 150° C. In one embodiment, no external heat is added to the adsorber. The pressure within the adsorber can range between 1 bar and 10 bars. In one embodiment, no additional gas, e.g., hydrogen is needed or added for the treatment process. In one embodiment, the liquid hourly space velocity (LHSV) varies between 0.1 and 50 $h^{-1}$, alternatively between 1 and 12 $h^{-1}$. In one embodiment, no mechanical stirring, mixing or agitation is applied to the process.

In one embodiment, it is desirable to remove water in a pretreatment of the solid adsorbent before using the adsorbent, as water adsorbed in the adsorbent may inhibit adsorption of impurities such as nitrogen and sulfur compounds. In one embodiment, the solid adsorbent is first dried at about 50 to 200° C. with a flowing dry gas. In another embodiment, a drying temperature of about 80 to 200° C. In another embodiment, the flowing gas is air, nitrogen, carbon dioxide, helium, oxygen, argon, and mixtures thereof. In another embodiment, the flowing gas is hydrogen, light hydrocarbon, e.g. methane, ethane, propane, butane, and mixtures thereof It should be noted that the solid adsorbent saturated with nitrogen compounds and/or sulfur compounds can be readily regenerated to restore its capacity. The regeneration of the solid adsorbent or removal of the sulfur/nitrogen compounds from the solid adsorbent can include heating the adsorbent to vaporize the impurity compounds, extraction of the impurities by an organic solvent or an aromatics-containing regenerant, gas stripping, vaporization at a reduced pressure, and combinations of the foregoing techniques. In one embodiment, the regeneration step involves passing a desorbing hydrocarbon solvent through a fixed layer of the adsorbent, but is not intended to be limited thereto. Another example includes passing an aromatics-containing desorbing solvent through the adsorbent, which can be in a powder or pellet form and is packed in a cylindrical vessel as a fixed bed. In one embodiment, the adsorbent is regenerated in a carbon oxide-rich environment as disclosed in U.S. Pat. No. 7,951,740, the relevant disclosures are included herein by reference. In one embodiment, the adsorbent is restored for at least 90% of the pre-treatment capacity. In another embodiment, the restoration capacity is at least 75%.

In one embodiment, the desorbing hydrocarbon solvent has boiling point in the range of 180 to 550° F. In another embodiment, the desorbing solvent is toluene. In another embodiment, the desorbing solvent is hydrocarbon containing at least one aromatic compound. In one embodiment, the regeneration may be performed at a temperature ranging from 10° C. to 200° C. The process of regeneration may be performed for between 10 minutes and 12 hours. When the regeneration is performed for a time period shorter than 10 minutes, the duration is so short that the adsorbed nitrogen/sulfur compounds are not sufficiently desorbed. When the regeneration is performed for a time period longer than 12 hours, the desorption effect reaches a maximum, and further operations become unnecessary.

In one embodiment, the treatment apparatus includes a cyclindrical vessel as a fixed bed for containing the solid adsorbent, with an inlet tube for the hydrocarbon feedstock. In another embodiment, the treatment fixed bed may have another inlet tube for introducing a desorbing gas, disposed such that the desorbing gas is supplied in a countercurrent direction of the inlet tube containing the hydrocarbon feedstock to be treated.

In one embodiment, the treatment process comprises passing the hydrocarbon feed containing nitrogen and sulfur compounds through a fixed layer of the supported ionic liquid adsorbent, but is not intended to be limited thereto. Optionally in yet another embodiment, for increased removal of sulfur and/or nitrogen, the hydrocarbon feed stream can be contacted with the extracting media multiple times. In one embodiment, the feedstock is treated (or purified) by passage through a multilayer bed with layers of different adsorbents, e.g., one layer for the removal of sulfur compounds and at least another layer for the removal of nitrogen compounds. In another embodiment, the feedstock is treated by passage through a plurality of beds in series, with the different beds containing different adsorbents for the target removal of different compounds or treatment of different feedstock. In yet another embodiment, the feedstock is treated by passage through a plurality of beds in parallel, allowing some beds to be taken out of operation to regenerate the adsorbent without affecting the continuity of the operation.

Reference will be made to the figures to further illustrate embodiments of the invention. The figures illustrate the invention by way of example and not by way of limitation In FIG. 1, treatment of the feed 2 is conducted as a continuous process in a fixed bed adsorber 4 which can have a length to diameter ratio of between 2 and 50. The adsorbent is physically stationary within the adsorber with no mechanical mixing during the process. In order to avoid channeling through the adsorbent bed and to ensure good mass transfer, the feed can be introduced to the adsorber at the bottom end and flows upward such that the product 8 is recovered at the top end of the adsorber. In an alternative embodiment, the feed and the adsorbent are contacted in a batch process within a vessel. Other embodiments utilize alternative types of equipment, including, but not limited to, fluidized bed and rotary bed absorbers, for example.

Periodically, the treatment process can be interrupted so that the adsorbent can be regenerated in order to restore its capacity for nitrogen/sulfur removal. After flow of feed 2 has ceased, a blowdown step is conducted in which the adsorbent is dried to remove excess hydrocarbon from the adsorbent. In one embodiment, this is accomplished using an inert gas purge, e.g., nitrogen. In another embodiment, this is accomplished using air purge. In another embodiment, this is accomplished using a refinery gas stream comprising $C_1$ to $C_6$ alkanes. The adsorbent can then be regenerated at a temperature between ambient conditions and an elevated temperature, alternatively between room temperature and 200° C., by contacting the adsorbent with an aromatics-containing regenerant such as, for example, toluene. Following the ceasing of the flow of regenerant, a second blowdown step is conducted in which the adsorbent is dried to remove excess regenerant. As shown in FIG. 1, the regenerant 6 can be introduced to the adsorber at the top end and removed as stream 10 from the adsorber at the bottom end. In one embodiment as shown in FIG. 1, a pair of adsorbers 4 and 4A are used in order to keep one adsorber in operation while the other adsorber is shut down for regeneration. The duration of the regeneration step is sufficient to allow the desired reactivation of the adsorbent. The adsorbent is capable of regeneration even after multiple regeneration steps. In one embodiment, the adsorbent is capable of complete regeneration. By "complete regeneration" is meant a recovery of at least 90% of the pre-regeneration treatment capacity of the adsorbent after regeneration.

The treatment process can be integrated with a number of other processing steps, including, but not limited to, hydrotreating, hydrocracking, hydroisomerization and/or hydrodemetallization. By first removing sulfur and nitrogen compounds, the process increases the ability to further remove impurities such as sulfur species from the feed in a downstream process. While not wishing to be bound by theory, it is believed that removing nitrogen compounds from the feed results in increased sulfur removal capacity by adsorption and/or hydrodesulfurization processes since both nitrogen and sulfur target the same active sites on adsorbents and hydroprocessing catalysts and nitrogen is preferentially adsorbed.

Figure 2:
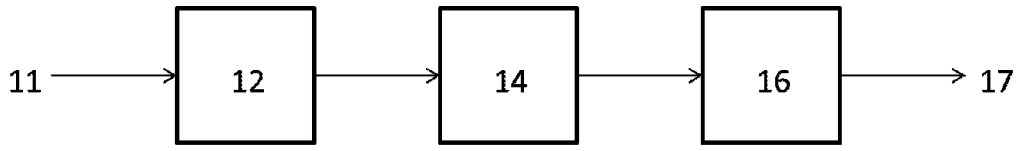
FIG. 2 illustrates an embodiment of a process for hydroprocessing a vacuum gas oil feed including an embodiment of the treatment process.

As one example of an integrated process including the treatment process, as illustrated in FIG. 2, the treatment process is used to treat a vacuum gas oil (VGO) feed 11 prior to the VGO contacting a hydrotreating catalyst bed 14 and subsequently a hydrocracking catalyst bed 16 in order to yield product 17. According to this embodiment, the presence of the treatment bed 12 allows greater flexibility in choice of feedstock. Additionally, catalyst life is extended since nitrogen compounds act as a poison to the catalysts. Milder conditions may be run in the hydrocracking processes, which may reduce operating costs and increase liquid yield. In one embodiment, the hydrocracking bed 16 is optionally bypassed or eliminated.

Figure 3:
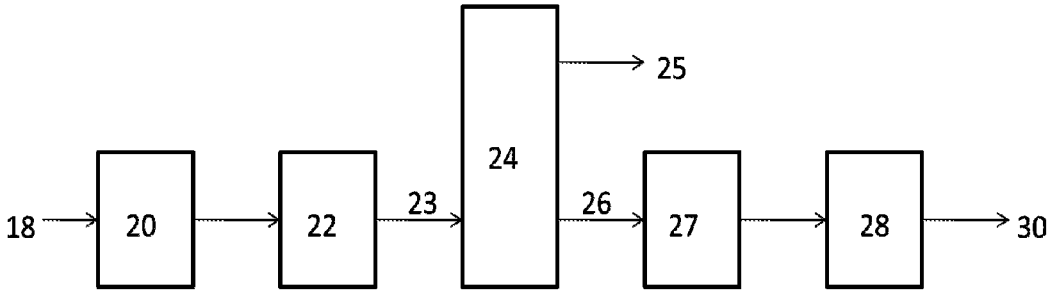
FIG. 3 illustrates an embodiment of a process for producing lube oil which includes which includes an embodiment of the treatment process.

Another example of an integrated process including the treatment process is illustrated in FIG. 3. In a process for converting a VGO feed 18 to a lube oil 30, a treatment bed 27 according to the present process is included between distillation column 24 and a bed of isomerization dewaxing catalyst 28. The VGO is first contacted with a hydrotreating catalyst bed 20 and subsequently a hydrocracking catalyst bed 22, and the resulting stream 23 is separated into at least one light fraction 25 and a base oil fraction 26. The base oil fraction 26 is contacted with an adsorbent comprising an organic heterocyclic salt deposited on a porous support in treatment bed 27 prior to contacting the base oil fraction with a bed of isomerization dewaxing catalyst 28, thus forming lube oil stream 30. The product stream can optionally be subjected to a subsequent hydrofinishing step (not shown) to saturate aromatic compounds in the stream. The treatment bed removes nitrogen compounds from the base oil stream, thus resulting in the ability to use mild operating conditions in the isomerization dewaxing process and increasing lube oil yield.

In another example of an integrated process including the treatment process, the process can also be used as a finishing step for improving the thermal stability of a jet fuel.

EXAMPLES

The following illustrative examples are intended to be non-limiting. In the examples, surface area of porous materials is determined by $N_2$ adsorption at its boiling temperature. BET surface area is calculated by the 5-point method at $P/P_0$=0.050, 0.088, 0.125, 0.163, and 0.200. Samples are first pre-treated at a temperature in the range of 200 to 400° C. for 6 hours in the presence of flowing, dry $N_2$ so as to eliminate any adsorbed volatiles like water or organics.

Mesopore pore diameter is determined by $N_2$ adsorption at its boiling temperature. Mesopore pore diameter is calculated from $N_2$ isotherms by the BJH method described in E. P. Barrett, L. G. Joyner and P. P. Halenda, "The determination of pore volume and area distributions in porous substances. I. Computations from nitrogen isotherms." J. Am. Chem. Soc. 73, pp. 373-380, 1951. Samples are first pre-treated at a temperature in the range of 200 to 400° C. for 6 hours in the presence of flowing, dry $N_2$ so as to eliminate any adsorbed volatiles like water or organics.

Total pore volume is determined by $N_2$ adsorption at its boiling temperature at P/P0=0.990. Samples are first pre-treated at a temperature in the range of 200 to 400° C. for 6 hours in the presence of flowing, dry $N_2$ so as to eliminate any adsorbed volatiles like water or organics.

Treatment capacity was measured with a fixed-bed adsorber loaded with an adsorbent in a continuous flow mode except elsewhere indicated. Hydrocarbon feed A was contacted with adsorbent at 12 LHSV and at ambient temperature and pressure. Denitrification and/or desulfurization capacity was calculated at 1 ppm N and/or S breakthrough based on a combination of indole and carbazole concentration in the effluent liquid stream on a weight percent basis as follows.

Denitrification Capacity (wt. %)=(N adsorbed in grams/Amount of adsorbent in grams)×100; wherein N adsorbed in grams=feed flow rate (cc/min)×runtime at 1 ppm N breakthrough (min)×feed density (g/cc)×feed N concentration (ppmw/g)×$10^{-6}$ (g/ppmw).

Desulfurization Capacity (wt. %)=(S adsorbed in grams/Amount of adsorbent in grams)×100; wherein S adsorbed in grams=feed flow rate (cc/min)×runtime at 1 ppm S breakthrough (min)×feed density (g/cc)×feed S concentration (ppmw/g)×$10^{-6}$ (g/ppmw).

Example 1

Preparation of Adsorbent

Activated carbon (obtained from MeadWestvaco Corporation, Richmond, Va.) was impregnated by the incipient wetness method with an acetone solution containing 3-butyl-1-methyl-imidazolium acetate to provide 40 wt % loading based on the bulk dry weight of the finished adsorbent. The solution was added to the carbon support gradually while tumbling the carbon. When the solution addition was completed, the carbon was soaked for 2 hours at ambient temperature. Then the carbon was dried at 176° F. (80° C.) for 2 hours in vacuum, and cooled to room temperature for adsorption application.

Example 2

Preparation of Adsorbent B

An acid-pretreated carbon support was formed by gradually adding 50 grams activated carbon to a 1000 mL nitric acid solution (6 M). The mixture was agitated for 4 hours at room temperature (approximately 20° C.). After filtration, the carbon was washed with deionized water until the pH value of the wash water approached 6. The treated carbon was dried at 392° F. (200° C.) for 4 hours in flowing dry air, and cooled to room temperature.

The acid-pretreated carbon was then impregnated by the incipient wetness method with an acetone solution containing 3-butyl-1-methyl-imidazolium acetate to provide 40 wt % loading based on the bulk dry weight of the finished adsorbent. The solution was added to the acid-treated carbon support gradually while tumbling the support. When the solution addition was completed, the carbon was soaked for 2 hours at ambient temperature. Then the carbon was dried at 176° F. (80° C.) for 2 hours in vacuum, and cooled to room temperature.

Example 3

Preparation of Adsorbent C

A silica alumina extrudate was prepared by mixing well 69 parts by weight silica-alumina powder (Siral-40, obtained from Sasol) and 31 parts by weight pseudo boehmite alumina powder (obtained from Sasol). A diluted $HNO_3$ acid aqueous solution (1 wt. %) was added to the powder mixture to form an extrudable paste. The paste was extruded in 1/16" (1.6 mm) cylinder shape, and dried at 250° F. (121° C.) overnight. The dried extrudates were calcined at 1100° F. (593° C.) for 1 hour with purging excess dry air, and cooled to room temperature. The sample had a surface area of 500 $m^2/g$ and pore volume of 0.90 mL/g by $N_2$-adsorption at its boiling point.

The calcined extrudates were impregnated by the incipient wetness method with an acetone solution containing 3-butyl-1-methyl-imidazolium acetate to provide 40 wt % ionic liquid based on the bulk dry weight of the finished adsorbent. The acetone solution was added to the silica alumina extrudates gradually while tumbling the extrudates. When the solution addition was completed, the extrudates were soaked for 2 hours at room temperature. Then the extrudates were dried at 176° F. (80° C.) for 2 hours in vacuum, and cooled to room temperature.

Example 4

Preparation of Adsorbent D

In a distillation apparatus, 30 g of silica (Silica gel 60, having an average pore size of 6 nm, obtained from Alfa Aesar, Ward Hill, Mass.) was dispersed in 100 mL dried toluene. 67 g 1-(tri-ethoxy-silyl)-propyl-3-methyl-imidazolium chloride was then gradually added. The mixture was stirred at 110° C. for 16 hours. After filtration, the excess of 1-(tri-ethoxy-silyl)-propyl-3-methyl-imidazolium chloride was removed by extraction with boiling $CH_2Cl_2$ in a Soxhlet apparatus. The remaining powder was dried in vacuum at 120° C. for two days. The content of imidazolium ion grafted on silica was 24 wt. % by CHN analysis (bulk dry adsorbent). The grafting of the imidazolium ion to silica surface can be represented schematically by:

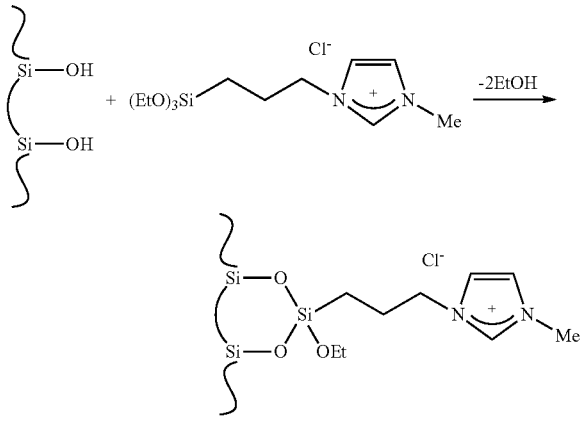

Example 5

Preparation of Adsorbent E

The preparation method was the same as that for Adsorbent D except for the replacement of silica gel with wide pore (150 Å (15 nm)) silica gel available from Alfa Aesar (Ward Hill, Mass.) as item number 42726. The content of imidazolium ion deposited on silica was 17 wt. % by CHN analysis (bulk dry adsorbent).

Example 6

Feeds for Denitrification and Desulfurization

Table 1 shows the S and N concentration of two feeds used for the evaluation of the denitrification capacity of Adsorbents A-E.

TABLE 1

| | Feed A | Feed B |
|---|---|---|
| Total S, ppm wt | 100 | 175 |
| Total N, ppm wt | 13 | 13 |
| Nitrogen in Indole | 4 ppm-wt | 4 ppm-wt |
| Nitrogen in Carbazole | 4 ppm-wt | 4 ppm-wt |
| Nitrogen in 2-Methyl Indoline | 5 ppm-wt | 5 ppm-wt |

Example 7

Denitrification Capacity of Adsorbents A to E

Table 2 compares the denitrification capacities of Adsorbents A-E, as well as silica gel 60 and acid-treated carbon supports. The denitrification was conducted in a fixed bed adsorber using the Feed A at 12.0 WHSV, and ambient conditions.

Adsorbent B (imidazolium ion deposited on acid-treated carbon) had the highest denitrification capacity of 0.39 mole N per mole imidazolium ion or 1.1 wt. % per gram adsorbent. Table 2 also shows the effect of the pore size of silica support on the denitrification capacity. Adsorbent E with large pore silica (150 Å) gave a denitrification capacity of 0.22 mole N/mole imidazolium ion, higher than that of 0.17 on Adsorbent D with 60 Å silica gel.

TABLE 2

| Adsorbent | Denitrification Capacity (wt. %, N adsorbed/adsorbent) | Denitrification Capacity (mole N adsorbed/mole adsorbent) |
|---|---|---|
| Silica Gel 60 | 0.04 | — |
| Acid-Treated Carbon | 0.06 | — |
| Adsorbent A | 0.68 | 0.24 |
| Adsorbent B | 1.1 | 0.39 |
| Adsorbent C | 0.60 | 0.21 |
| Adsorbent D | 0.25 | 0.17 |
| Adsorbent E | 0.25 | 0.22 |

Example 8

Denitrification Operating Modes

Table 3 shows the removal of N compounds in Feed A by Adsorbent D by a solid-liquid extraction method. This suggests that denitrification can be performed in the batch mode although a higher denitrification capacity is achieved in the fixed bed continuous flow mode.

TABLE 3

| Adsorption Operating Mode | Fixed Bed Continuous with Feed A | Solid-Liquid Extraction – Batch with Feed A[a] |
|---|---|---|
| Denitrification Capacity (mole N/mole imidazolium ion) | 0.17 | 0.02 |

[a]Ratio of Feed A to Adsorbent D = 2.5/0.5 by weight, agitated at 25° C. for 8 hours

Example 9

Regeneration of the Adsorbent

Figure 4:
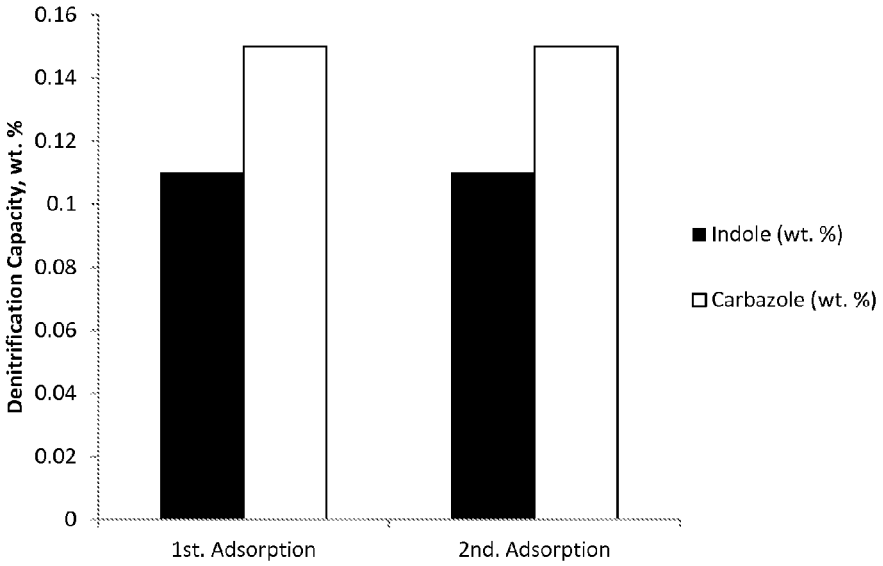
FIGS. 4 and 5 illustrate the treatment capacity before and after regeneration of adsorbents in an embodiment of the treating process.
Figure 5:
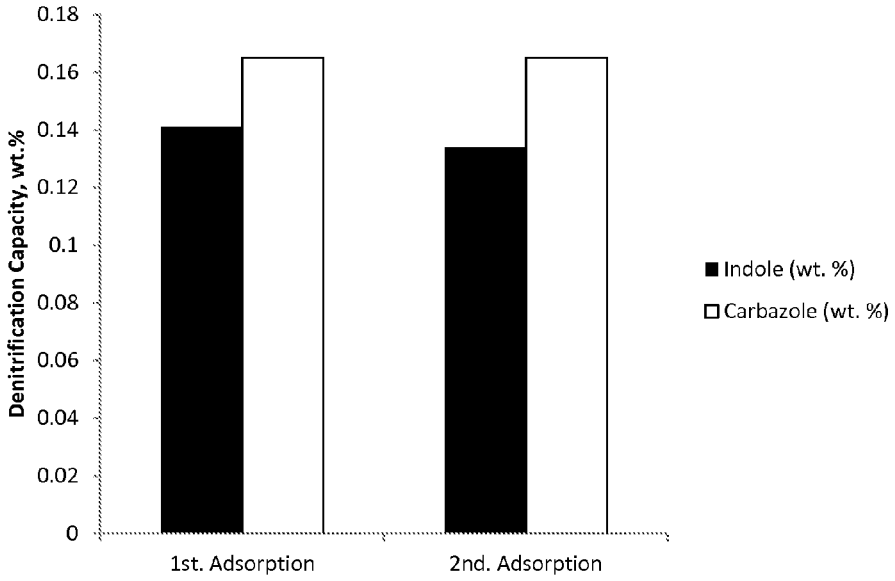

FIGS. 4 and 5 show the denitrification capacities of Adsorbent D in the first and second cycle for removing neutral nitrogen compounds in Feed A and Feed B, respectively. Denitrification was conducted in a continuous flow fixed bed adsorber at LHSV of 12 $h^{-1}$, and ambient temperature and pressure. The denitrification capacity was calculated at 1 ppm N breakthrough (combination of indole and carbazole) in the effluent liquid stream. After the uptake, the adsorbent was regenerated online with toluene at LHSV of 50 $h^{-1}$ and ambient conditions.

The denitrification capacity of Adsorbent D is slightly higher with Feed B than Feed A. This is attributed to the slight difference in their aromatics content. FIGS. 4 and 5 illustrate that Adsorbent D is fully regenerable by toluene solvent wash after the first uptake. There was no detectable difference in denitrification capacity between the first and second runs of the adsorption process, indicating complete regeneration. This may be due to the covalent bond between the imidazolium ion and the silica support.

Example 10

Preparation of Adsorbent F

The acid-pretreated carbon as described in Example 2 was impregnated by the incipient wetness method with an acetone solution containing N-butyl-pyridinium chloride to provide 15 wt % loading based on the bulk dry weight of the finished adsorbent. The solution was added to the acid-treated carbon support gradually while tumbling the support. When the solution addition was completed, the carbon was soaked for 2 hours at ambient temperature. The carbon adsorbent was dried at 176° F. (80° C.) for 2 hours in vacuum, and cooled to room temperature.

Example 11

Desulfurization Capacity of Adsorbent F

This experiment was carried out in a fixed-bed adsorber in a continuous flow mode. Hydrocarbon feed A was contacted with the adsorbent at 10 LHSV and at ambient temperature and pressure. Desulfurization capacity was determined as 0.10 wt % at 1 ppm S breakthrough, based on a combination of 50 ppm dibenzothiophene and 50 ppm 4,6-dimethyldibenzothiophene concentration in the effluent liquid stream on a weight percent basis.

For the purpose of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained and/or the precision of an instrument for measuring the value, thus including the standard deviation of error for the device or method being employed to determine the value.

The use of the term "or" in the claims is used to mean "and/or" unless explicitly indicated to refer to alternatives only or the alternative are mutually exclusive, although the disclosure supports a definition that refers to only alternatives and "and/or." The use of the word "a" or "an" when used in conjunction with the term "comprising" in the claims and/or the specification may mean "one," but it is also consistent with the meaning of "one or more," "at least one," and "one or more than one." Furthermore, all ranges disclosed herein are inclusive of the endpoints and are independently combinable. In general, unless otherwise indicated, singular elements may be in the plural and vice versa with no loss of generality. The term "include" and its grammatical variants are intended to be non-limiting, such that recitation of items in a list is not to the exclusion of other like items that can be substituted or added to the listed items.

It is contemplated that any aspect of the invention discussed in the context of one embodiment of the invention may be implemented or applied with respect to any other embodiment of the invention. Likewise, any composition of the invention may be the result or may be used in any method or process of the invention. This written description uses examples to disclose the invention, including the best mode, and also to enable any person skilled in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

What is claimed is:

1. A method for treating a hydrocarbon feed, comprising:

contacting the feed with an adsorbent comprising at least one nitrogen-containing organic heterocyclic salt deposited on an inorganic porous support selected from the group consisting of molecular sieve, silica, alumina, silica-alumina, activated carbon, clay and mixtures thereof, whereby undesirable nitrogen and sulfur impurities in the feed are adsorbed by the adsorbent, thereby resulting in a treated product containing a reduced amount of impurities as compared with the feed.

2. The method of claim 1, wherein the contact is carried out without the need for any addition of any external hydrogen gas.

3. The method of claim 1, wherein the adsorbent is stationary in a fixed bed adsorber in a continuous process.

4. The method of claim 1, wherein no external heat is applied to the process.

5. The method of claim 2, wherein no mechanical stirring is applied to the process.

6. The method of claim 1, wherein the feed contacts the adsorbent at a temperature in the range of 0° C. to 200° C.

7. The method of claim 1, wherein the treated product contains less than 500 ppm nitrogen.

8. The method of claim 1, wherein the treated product contains less than 1 ppm nitrogen.

9. The method of claim 1, wherein the inorganic porous support comprises activated carbon which has been oxidized having a BET surface area of between 200 $m^2/g$ and 3000 $m^2/g$.

10. The method of claim 1, wherein the inorganic porous support comprises an inorganic material selected from the group consisting of molecular sieve, silica, alumina, silica-alumina, clay and mixtures thereof having a BET surface area of between 50 $m^2/g$ and 1500 $m^2/g$.

11. The method of claim 1, wherein the inorganic porous support comprises pores having an average pore diameter of between 0.5 nm and 20 nm and a pore volume of between 0.1 and 3 $cm^3/g$.

12. The method of claim 1, wherein the nitrogen-containing organic heterocyclic salt has a general formula of:

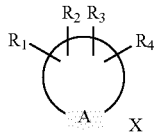

wherein:

A is a nitrogen cation containing heterocyclic group selected from the group consisting of imidazolium, pyrazolium, 1,2,3-triazolium, 1,2,4-triazolium, pyridinium, pyrazinium, pyrimidinium, pyridazinium, 1,2,3-triazinium, 1,2,4-triazinium, 1,3,5-triazoinium, quinolinium, and isoquinolinium;

$R_1$, $R_2$, $R_3$, and $R_4$ are substituent groups attached to the carbon or nitrogen of the heterocyclic group A, independently selected from the group consisting of hydroxyl, amino, acyl, carboxyl, linear unsubstituted $C_1$-$C_{12}$ alkyl groups, branched unsubstituted $C_1$-$C_{12}$ alkyl groups, linear $C_1$-$C_{12}$ alkyl groups substituted with oxy, amino, acyl, carboxyl, alkenyl, alkynyl, trialkoxysilyl, and alkyldialkoxysilyl groups, branched substituted $C_1$-$C_{12}$ alkyl groups substituted with oxy, amino, acyl, carboxyl, alkenyl, alkynyl, trialkoxysilyl, and alkyldialkoxysilyl groups; and X is an inorganic or organic anion selected from the group consisting of fluoride, chloride, bromide, iodide, aluminum tetrachloride, heptachloroaluminate, sulfite, sulfate, phosphate, phosphoric acid, mono hydrogen phosphate, bicarbonate, carbonate, hydroxide, nitrate, trifluoromethanesulfonate, sulfonate, phosphonate, carboxy late groups of $C_2$-$C_{18}$ organic acids, and chloride or fluoride substituted carboxylate groups.

13. The method of claim 1, wherein the nitrogen-containing organic heterocyclic salt comprises an imidazolium ion.

14. The method of claim 13, wherein the adsorbent has a denitrification capacity of at least 0.17 mole of nitrogen adsorbed per mole of imidazolium ion.

15. The method of claim 1, further comprising regenerating the adsorbent by contacting the adsorbent with an aromatics-containing regenerant.

16. The method of claim 15, wherein the adsorbent is regenerated completely in the regenerating step.

17. The method of claim 1, wherein the feed is selected from hydrotreated and or hydrocracked products, coker products, straight run feed, distillate products, FCC bottoms, atmospheric and vacuum bottoms, vacuum gas oils and unconverted oils.

18. The method of claim 1, followed by at least one hydroprocessing step selected from hydrotreating, hydrocracking, hydroisomerization and hydrodemetallization.

19. A method for hydroprocessing a hydrocarbon feed comprising contacting the feed with a hydrotreating catalyst followed by a hydrocracking catalyst, wherein prior to contacting the feed with the hydrotreating catalyst, the feed is contacted with an adsorbent comprising a nitrogen-containing organic heterocyclic salt suitably deposited on an inorganic support wherein the resulting hydrocarbon feed stream has a sulfur content, nitrogen content, or combined sulfur/nitrogen content that is reduced by at least 50% compared with the feed prior to contact with the adsorbent.

20. A method for producing a lube oil comprising contacting a hydrocarbon feed with a hydrocracking catalyst, separating the hydrocracked feed into at least one light fraction and a base oil fraction, and contacting the base oil fraction with a bed of isomerization dewaxing catalyst to produce a stream, wherein prior to contacting the feed with the isomerization dewaxing catalyst, the base oil fraction is contacted with an adsorbent comprising a nitrogen-containing organic heterocyclic salt suitably deposited on an inorganic support wherein the resulting hydrocarbon feed stream has a sulfur content, nitrogen content, or combined sulfur/nitrogen content that is reduced by at least 50% compared with the feed prior to contact with the adsorbent.

21. The method of claim 1, wherein the nitrogen-containing organic heterocyclic salt suitably deposited on the inorganic support so that the resulting hydrocarbon feed stream has a sulfur content, nitrogen content, or combined sulfur/nitrogen content that is reduced by at least 50% compared with the feed prior to contact with the adsorbent.

* * * * *